US005890842A

United States Patent [19]

Dahill

[11] Patent Number: 5,890,842

[45] Date of Patent: Apr. 6, 1999

[54] GROUND ANCHOR

[76] Inventor: Henry W. Dahill, 2378 NW. McDougal Ct., Prineville, Oreg. 97754

[21] Appl. No.: 844,981

[22] Filed: Apr. 23, 1997

[51] Int. Cl.[6] ..... E02D 5/74

[52] U.S. Cl. ..... 405/244; 405/232; 411/455; 52/155

[58] Field of Search ..... 405/154, 244, 405/232; 411/451, 455, 456, 922; 52/103, 155; 135/118

[56] References Cited

U.S. PATENT DOCUMENTS

| | | | |
|---|---|---|---|
| 961,992 | 6/1910 | Underwood | 411/455 X |
| 1,264,683 | 4/1918 | Ricci | 411/456 |
| 1,821,400 | 9/1931 | Peirce | 411/922 X |
| 3,717,067 | 2/1973 | Vick et al. | 411/455 |
| 3,717,966 | 2/1973 | Reichert . | |
| 3,810,364 | 5/1974 | Johnson . | |
| 4,132,498 | 1/1979 | Ikeda et al. . | |
| 4,768,900 | 9/1988 | Burland | 405/244 |
| 5,108,227 | 4/1992 | Bergey | 405/154 |
| 5,154,540 | 10/1992 | Barley . | |
| 5,175,966 | 1/1993 | Remke et al. . | |
| 5,236,438 | 8/1993 | Wilk | 411/455 X |
| 5,245,715 | 9/1993 | Dinkins | 135/118 X |
| 5,492,452 | 2/1996 | Kirsch et al. | 411/455 |
| 5,522,678 | 6/1996 | Marshall et al. . | |

FOREIGN PATENT DOCUMENTS

| | | | |
|---|---|---|---|
| 916048 | 1/1963 | United Kingdom | 411/455 |

*Primary Examiner*—Tamara L. Graysay
*Assistant Examiner*—Jong-Suk Lee
*Attorney, Agent, or Firm*—Chase & Yakimo, L.C.

[57] ABSTRACT

A ground anchor includes a planar drive head with a shank extending therefrom. The shank includes a plurality of inline segments with each segment including a cylindrical shaft portion and a cone-shaped tapered portion. The tapered portion of each upstream segment is connected to a shaft portion of an adjacent downstream segment. This relationship presents a plurality of indentations along the length of the shaft. Upon penetration of the shank into the ground, the earth collapses into the indentations which resist withdrawal of the anchor from the ground due to forces acting on the structure secured to the anchor such as a tarpaulin or the like. The planar drive head lies adjacent the ground to preclude above ground interference.

12 Claims, 4 Drawing Sheets

GROUND ANCHOR

BACKGROUND OF THE INVENTION

This invention relates to a ground anchor and, more particularly, to an anchor configured to resist above the ground forces acting thereon.

Various types of earth anchors have been proposed for securing various structures, e.g. a tarpaulin, to the ground. Although assumably effective in their operation such anchors have become relatively complex in construction, which increases their manufacturing costs. Moreover, such anchors may be difficult to drive into the ground. Once driven, the head of the anchor may protrude above ground and cause above ground interference which may lead to injury.

SUMMARY OF THE INVENTION

In response thereto I have invented a ground anchor which presents a generally planar drive head having an elongated, ground-penetrating shank extending therefrom. The shank comprises a plurality of longitudinally aligned segments. Each segment presents a shaft portion or proximal end and a tapered portion or distal end extending therefrom. The tapered portion terminates at the proximal end of the shaft portion of an adjacent downstream segment. As such, indentations are formed at the juncture of adjacent segments with the tapered portion of the distal shank segment, relative to the head, terminating in a ground penetrating point. Upon ground penetration of the shank, the earth collapses into the indentations so as to more firmly anchor the shank at the plurality of indentations along the shank. The planar head of the anchor is positioned along the ground to preclude above the ground extension. Upon extension of the shank of the anchor through an aperture in an above the ground structure, such as a tarpaulin or the like, the anchor firmly secures the tarpaulin to the ground.

It is therefore a general object of the invention to provide an improved ground anchor.

Another object of this invention is to provide an anchor, as aforesaid, having a drive head and a segmented shank extending therefrom.

A further object of this invention is to provide a ground anchor, as aforesaid, the segmented shank presenting a plurality of indentations along the length of the shank, the indentations presenting areas for receiving collapsed earth therein upon shank penetration.

Another particular object of this invention is to provide an anchor, as aforesaid, which is economical to manufacture and easy to use.

Other objects and advantages of this invention will become apparent from the following description taken in connection with the accompanying drawings, wherein is set forth, by way of illustration and example, a now preferred embodiment of the invention.

DESCRIPTION OF THE PREFERRED EMBODIMENT

Figure 1:
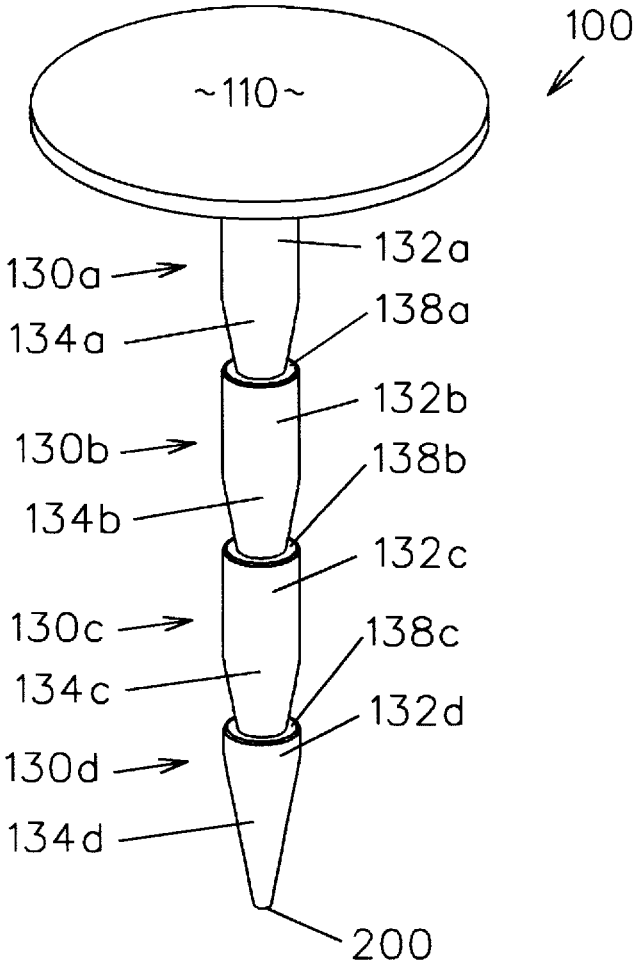
FIG. 1 is a perspective view showing a ground anchor utilizing four inline shank segments.
Figure 2:
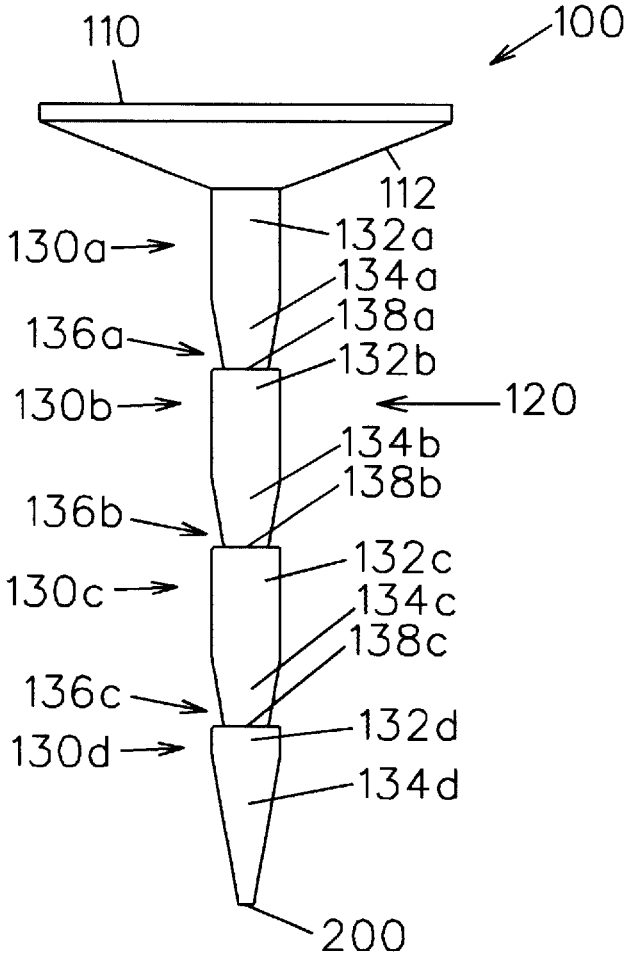
FIG. 2 is an elevation view of the anchor of FIG. 1.
Figure 3:
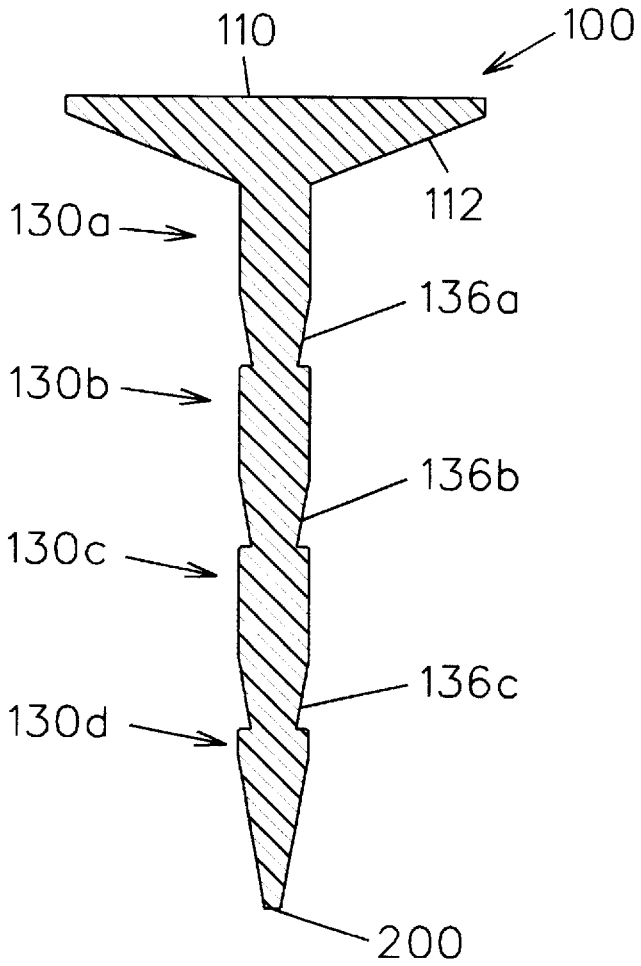
FIG. 3 is a sectional view of the anchor of FIG. 2 taken along the center line thereof.
Figure 4:
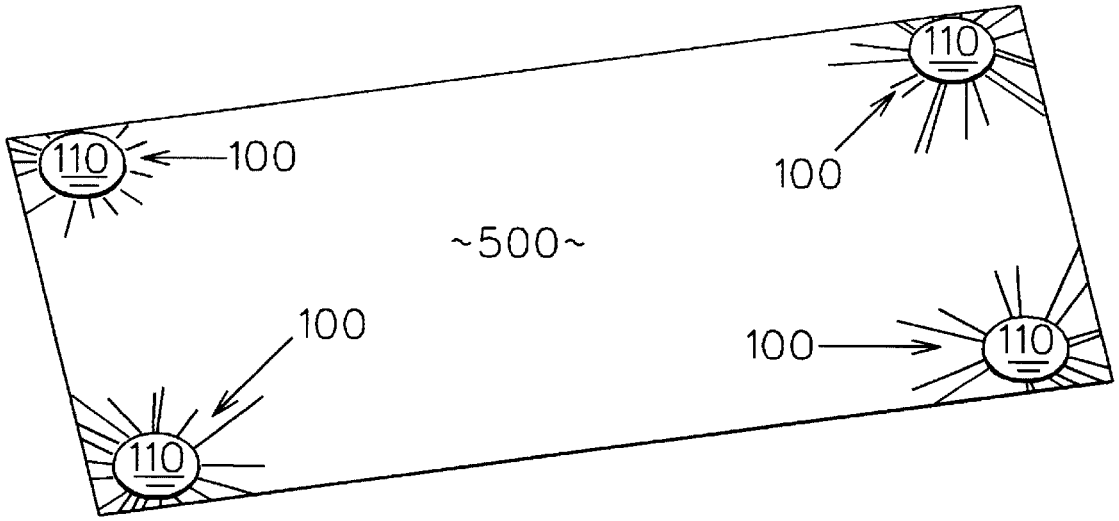
FIG. 4 illustrates a tarpaulin held in place by four ground anchors as shown in FIGS. 1–3.

Turning more particularly to the drawings, FIG. 1 shows the anchor 100 as comprising a drive head 110 and shank

120 extending therefrom. A free distal point 200 is longitudinally spaced from the head 110 for initial ground penetration upon pressure being exerted on the head 110 either by a tool or the user's hand or foot. As shown, the drive head 110 presents an underlying tapered base 112 to enhance ground penetration.

The shank 120 comprises a plurality of longitudinally adjacent segments 130*a*, 130*b*, 130*c*, and 130*d*. Each segment is generally identical in construction and comprises a shaft portion 132*a*, 132*b*, 132*c*, 132*d* and a tapered portion 134*a*, 134*b*, 134*c*, 134*d* extending from the bottom of each shaft portion. The lower end of each tapered portion terminates at the upper/proximal end of the adjacent downstream shaft portion. As such a plurality of annular indentations 136*a*, 136*b*, 136*c* are presented between adjacent segments 130*a*, 130*b*, 130*c*, 130*d*. Each indentation includes a shoulder 138*a*, 138*b*, 138*c* presented by the upper end of each shaft 132*b*, 132*c*, 132*d*.

The tapered portion 134*d* of the most distal segment 130*d* terminates in a free point 200 for initial ground penetration. The length of the tapered portion 134*d* of segment 130*d* is greater than the length of the tapered portions of the upstream segments 130*a*, 130*b*, 130*c* so as to enhance initial ground penetration.

In use the shank 120 is initially extended through an aperture in the structure, such as the tarpaulin 500, the tarpaulin aperture usually being reinforced with a grommet or the like. Upon pressure being exerted on the drive head 110, the point 200 penetrates the earth and is driven therein until the drive head 110 lies adjacent the ground. Upon the head 110 being level with the ground, the tarpaulin 500 portion is secured to the ground.

Upon the shank 120 penetrating the earth, as displaced by the shaft portion of each segment, collapses into the annular indentations 136*a*, 136*b*, 136*c* including atop the shoulders 138*a*, 138*b*, 138*c*. This action occurs at a plurality of points longitudinally spaced apart along the extent of the shank 120 proper. I have found that this structure presents a plurality of anchor points along the shank 120. The collapse of the earth into such indentations more firmly secures the embedded shank 120 in the earth so as to resist upward movement of the shank which may be caused by forces acting on the tarpaulin 500, e.g. by winds or the like. Such forces must overcome a plurality of anchor points presented along the length of the shank. Thus, the tarpaulin is firmly held in place.

Although four shank segments 130*a*, 130*b*, 130*c*, 130*d* have been shown, it is understood that the number of shank segments can be varied.

It is to be understood that while a certain form of this invention has been illustrated and described, it is not limited thereto except insofar as such limitations are included in the following claims and allowable functional equivalent thereof.

Having thus described the invention, what is claimed as new and desired to be secured by Letters Patent is as follows:

1. A ground anchor adapted for earth penetration comprising:

a head adapted to be positioned level with the earth upon anchor penetration by user induced forces thereon;

a shank extending from said head, said shank comprising an upper end connected to said head and a free distal end adapted for penetration into the earth, said shank further comprising:

a plurality of fixed inline segments intermediate said head and a most distal segment relative to said head, each of said inline segments generally identical in configuration and comprising:

an elongated shaft portion having an imaginary central axis normal to said head, said shaft portion extending between an upper end and a lower end, said upper end of said shaft portion of said segment adjacent said head connected thereto;

an inwardly tapered portion extending from said lower end of said shaft portion and along said central axis, a length of said tapered portion alone said central axis less than a length of said shaft portion along said central axis, said tapered portion of one upstream segment connected to an upper end of said shaft portion of an adjacent downstream inline or said most distal segment to present an indentation of a generally horizontal surface between adjacent upstream and downstream segments, said most distal segment presenting a shaft portion and a tapered portion extending from said shaft portion and presenting a free end, said shaft portion of said most distal segment having a cross sectional area generally congruent to said shaft portions of said upstream inline segments, said free end presenting said free distal end of said shank adapted for earth penetration upon exertion of user forces on said head, said indentations adapted to resist withdrawal of said shank from earth collapsing atop said indentations upon said earth penetration of said shaft portions, to resist withdrawal of said anchor from the earth.

2. The anchor as claimed in claim 1 wherein each shaft portion is cylindrical in configuration, each cylindrical configuration of each inline segment generally equal in length and cross sectional area.

3. The anchor as claimed in claim 2 wherein each of said inline segment tapered portions is cone-shaped in configuration, said free tapered portion of said most distal segment presenting a point to enhance the earth penetration.

4. The anchor as claimed in claim 3 wherein each of said indentations between adjacent upstream and downstream segments presents an annular shoulder presented by a top surface of said shaft portion of each said adjacent downstream segment.

5. The anchor as claimed in claim 1 wherein each of said indentations annularly extends about an exterior of said shank.

6. The anchor as claimed in claim 1 wherein said head comprises:

a planar top surface;

a tapered lower surface extending from said top surface and connected to said upper end of said shaft portion of said segment adjacent said head.

7. A ground anchor for earth penetration comprising:

a head for user induced pressure thereon;

a shank extending from said head, said shank comprising:

a distal segment relative to said head including a proximal portion and a point extending therefrom adapted for initial around penetration; a plurality of fixed inline segments of identical configuration intermediate said head and said distal segment and including a proximal inline segment first adjacent said head with at least one additional inline segment intermediate said proximal inline segment and distal segment, each inline segment having a proximal portion generally equal in length and cross sectional area and a distal portion relative to said head generally equal in length and cross sectional area, said length of said proximal portion of each inline segment greater than said distal portion of each inline segment, said distal portion of each inline segment being connected to said proximal portion of an adjacent downstream inline or distal segment, said distal portion of each inline segment having a configuration relative to said proximal portion of each downstream inline or distal segment to present a shoulder of a uniform horizontal surface area between adjacent upstream and downstream segments, each of said shoulders presenting a surface for collapse of earth thereon upon a user induced pressure on said head for penetration of said shank into the earth, said uniform shoulders adapted to resist withdrawal of said shank from the collapsed earth thereon.

8. The anchor as claimed in claim 7 wherein said distal portion of each inline segment is of a reduced cross sectional area relative to said proximal portion of each segment.

9. The anchor as claimed in claim 7 wherein said proximal portion of each inline segment is generally cylindrical in configuration.

10. The anchor as claimed in claim 9 wherein said distal portion of each inline segment is generally tapered in configuration relative to said proximal portion, said tapered configuration presenting a reduced cross-sectional area relative to said proximal portion, said distal portion of said distal segment of said plurality of segments terminating at a point to enhance the ground penetration.

11. The anchor as claimed in claim 7 wherein each of said shoulders annularly extends about said shank.

12. The anchor as claimed in claim 7 wherein said head comprises:

a planar top surface;

a tapered lower surface extending from said top surface and connected to said proximal portion of said distal first segment adjacent said head.

* * * * *

UNITED STATES PATENT AND TRADEMARK OFFICE

CERTIFICATE OF CORRECTION

PATENT NO. : 5,890,842

DATED : April 6, 1999

INVENTOR(S) : Henry W. Dahill

It is certified that error appears in the above-identified patent and that said Letters Patent is hereby corrected as shown below:

Column 3, line 10, delete "alone" and substitute --along--.

Signed and Sealed this

Thirteenth Day of July, 1999

*Attest:*

Q. TODD DICKINSON

*Attesting Officer*

*Acting Commissioner of Patents and Trademarks*